United States Patent [19]

Tanaka et al.

[11] 4,241,007

[45] Dec. 23, 1980

[54] METHOD OF PRODUCING WATER-ABSORBENT SOLID CLOTH-LIKE ARTICLES

[75] Inventors: Yoshihiko Tanaka; Teruhiko Sugimori; Hideaki Habara, all of Otake, Japan

[73] Assignee: Mitsubishi Rayon Co., Ltd., Tokyo, Japan

[21] Appl. No.: 20,839

[22] Filed: Mar. 15, 1979

[30] Foreign Application Priority Data

Apr. 13, 1978 [JP] Japan ..... 53-43579

[51] Int. Cl.[3] ..... D21J 3/00

[52] U.S. Cl. ..... 264/324; 162/224

[58] Field of Search ..... 264/324; 162/224; 93/1 R

[56] References Cited

U.S. PATENT DOCUMENTS

| | | | |
|---|---|---|---|
| 1,989,048 | 1/1935 | Winter | 162/224 |
| 3,671,386 | 6/1972 | Jakobsen | 162/224 |
| 4,096,230 | 6/1978 | Haerr | 264/324 X |

FOREIGN PATENT DOCUMENTS 50-53690 5/1975 Japan .

*Primary Examiner*—Thomas P. Pavelko

*Attorney, Agent, or Firm*—Armstrong, Nikaido, Marmelstein & Kubovcik

[57] ABSTRACT

A method of producing water-absorbent cloth-like articles is disclosed. A binderless cellulosic nonwoven fabric is placed in a mold and compressed under a pressure of 1100 to 1500 kg/cm$^2$, preferably 1200 to 1300 kg/cm$^2$. The molding so produced will recover to original form when water is added to it.

2 Claims, 3 Drawing Figures

METHOD OF PRODUCING WATER-ABSORBENT SOLID CLOTH-LIKE ARTICLES

This invention relates to methods of producing compactly molded portable water-absorbent cloth-like articles. More particularly the present invention relates to a method of producing compressed water-absorbent solid cloth-like articles by compactly compressing and molding a water-absorbent cloth-like material which can be recovered to the shape as before the compression by utilizing its water-absorbency when water is added to it prior to its use.

The conventional cloth having a water-absorbency is required to be water-absorbent, has therefore many pores and air gaps and is necessarily so bulky as to have problems of a great defect in carrying it and of requiring a large amount of material in packing it. It has been desired very much to solve these problems.

Also, a water-absorbent cloth-like article small in the bulk is very suitable to picnics, travels and angling in respect of the portability. Therefore, a compact cloth-like article has been desired to be developed in this respect.

As one method of solving these problems, a method of molding towels characterized in that a towel folded in advance is painted with 5 to 30% by weight of an aqueous solution of a water-soluble paste agent so that the residual paste agent may be 0.1 to 5% on the weight of the towel, is then put into any desired mold and is placed under a pressure of 5 to 60 kg/cm$^2$ for more than 2 minutes is introduced in Japanese Patent Laid-Open No. 53690/1975.

In such method, a pipette, spraying nozzle or roller is used to apply the paste. The method is therefore very complicate. In order to prevent the molding from collapsing after being molded of the paste, the pressure must be retained for several minutes at the time of the compression. Some paste to be used is likely to be detrimental or unpleasant. If the amount of the paste agent is small, the molding will be insufficient. If it is too large, on the contrary, there will be a problem in the use. The method involves many of such problems and can not be said to be well satisfactory.

In order to improve these defects, there is suggested Japanese Utility Model Laid-Open No. 36,565/1977 whose subject matter is a solid cake-like towel made by putting a towel or nonwoven fabric into any desired mold and compressing and molding it under a compression pressure of 30 to 1,000 kg/cm$^2$. However, when the present inventors worked said invention by cutting a binderless cellulosic nonwoven fabric to be of fixed dimensions and putting it into a desired mold, with the pressure less than 1,000 kg/cm$^2$, the fabric was recognized to be wrinkled in the peripheral wall part and to tend to swell on the peripheral edge of the upper surface part. This seems to be caused by the fact that the binderless cellulosic nonwoven fabric is higher in the compression elasticity than the towel or any other nonwoven fabric. Such form not only impairs the commodity value in the appearance but is also likely to obstruct the continuous operation in case it is used in an automatic vendor.

As a result of making various studies on the operation to eliminate the above described defects in molding a cellulosic nonwoven fabric of fixed dimensions into a water-absorbent solid cloth-like article, the present inventors have completed the present invention by discovering that such defects as are described above are due to the shortage of the operating pressure.

Figure 1:
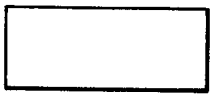
FIG. 1 is an elevation of a water-absorbent solid cloth-like article of the present invention.

The present invention is to produce a compressed water-absorbent solid cloth-like article by putting a binderless cellulosic nonwoven fabric into any desired mold and compressing and molding it under a pressure of 1100 to 1500 kg/cm$^2$ or preferably 1200 to 1300 kg/cm$^2$ so that said molding may recover to the original form when water is added to it.

When the compression pressure at the time of the compression and molding is less than 1100 kg/cm$^2$, the compressed molding will be wrinkled in the peripheral wall part and will swell on the peripheral edge of the upper surface part, will not become flat and therefore will not be desirable. By the way, even if the compression pressure exceeds 1500 kg/cm$^2$, the form of the compressed product will be little different. However, if the waste of the energy is considered, it will not be desirable. If the compression pressure exceeds 2000 kg/cm$^2$, there will occur such problem that the cloth to which water is added after the compression and molding will partly break or will remarkably reduce in the strength. It is not desirable.

In case the water-absorbent cloth-like article compressed under the conditions of the present invention is used as wet, when water is added to it, it will recover to be of the form as before the compression and will be very convenient. In case the cloth-like article is used, for example, as a wet rolled towel, when it is desired to be cold as in summer, cold water may be added to it and, when it is desired to be warm as in winter, warm water may be added to it. Thus it can be used at any desired temperature. In case it is an object to absorb water as in blotting paper or a duster, the compressed article of the present invention very high in the water-absorbency will be functionally optimum. Further, as the compressed article is compact and is molded to be of the same dimensions, it is convenient to handle in automatic vendors used well today and expected to more and more develop hereafter. Further, in the present invention, such impurity as a paste agent is not used and therefore the product is very sanitary, is not unpleasant in the use and is advantageous in the quality. As in the above, it has very desirable points in the form and quality.

By the way, a binderless cellulosic nonwoven fabric developed by the present applicant company (suggested, for example, in U.S. Pat. No. 3,832,281, Italian Pat. No. 962,732, West German Pat. No. 2,232,966) is very desirable as a material to be compressed according to the present invention, and the material may have a water content of lower than 50%.

The present invention shall be explained with examples in the following:

EXAMPLE 1

A binderless cellulosic nonwoven fabric ("TCF", Trade mark of binderless cellulosic nonwoven fabrics produced by Mitsubishi Rayon Co.) was cut to be of 30×30 cm (about 5 g) and was folded to be about 7 cm wide. The three sheets were rolled together to be cylindrical and were put into a cylindrical metal mold of a diameter of about 30 mm. The fabric within the mold was compressed under a pressure of about 1200 kg/cm$^2$. When the nonwoven fabric was then taken out, such solid cloth-like article of a diameter of 30 mm and a height of 10 mm was obtained. When water was added to this article, a cylindrical wet rolled towel recovered to be of a height of 6 cm was obtained. Until water was added after the compression and molding, the compressed nonwoven fabric did not vary in the form. Further, after water was added, the nonwoven fabric was nothing different in the strength from before the compression.

CONTROL 1

Figure 2:
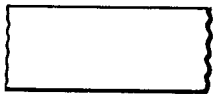
FIG. 2 is an elevation of a solid cloth-like article of a control.
Figure 3:
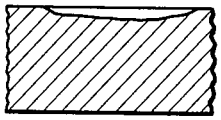
FIG. 3 is a vertically sectioned view of the solid cloth-like article of the control.

A solid cloth-like article was obtained by exactly the same method as in Example 1 except that the pressure at the time of compression and molding was 1000 kg/cm$^2$. This cloth-like article was somewhat short in the pressure at the time of molding and therefore had such appearances as in FIGS. 2 and 3 on the attached sheet.

CONTROL 2

A solid cloth-like article was obtained by exactly the same method as in Example 1 except that the pressure at the time of compression and molding was 2000 kg/cm$^2$. This cloth-like article was stable in the form but was low in the strength when recovered to the original form by adding water, was broken in some place and could not function as a compressed nonwoven cloth.

EXAMPLE 2

A cellulosic nonwoven fabric ("TCF") was cut to be of 30×30 cm (about 5 g), was triply folded to be about 10 cm wide, was cylindrically rolled to be of a diameter of 20 mm and was put into a cylindrical metal mold. The fabric within the mold was compressed under a pressure of about 1500 kg/cm$^2$. When the nonwoven fabric was then taken out, such solid cloth-like article of a diameter of 20 mm and a height of 15 mm as in FIG. 1 was obtained. When water was added to this cloth-like article, a cylindrical wet rolled towel recovered to be of a height of about 8 cm was obtained. Until water was added after the compression and molding, the compressed cellulosic nonwoven fabric did not vary in the form. After water was added, the nonwoven fabric was not different at all in the strength from before the compression.

We claim:

1. A method of producing a water-absorbent solid cloth-like article characterized by putting a binderless cellulosic nonwoven fabric into any desired mold and compressing and molding said binderless cellulosic nonwoven fabric under a pressure of 1100 to 1500 kg/cm$^2$ to give said fabric a water-absorption recovering property.

2. A method in accordance with claim 1, wherein said pressure is 1,200 to 1,300 kg/cm$^2$.

* * * * *